United States Patent [19]

Turkki

[11] Patent Number: 4,966,643

[45] Date of Patent: Oct. 30, 1990

[54] METHOD FOR ATTACHING A LABEL TO A SURFACE OF A PACKAGE

[75] Inventor: Pekka Turkki, Helsinki, Finland

[73] Assignee: Valmet Paper Machinery, Inc., Helsinki, Finland

[21] Appl. No.: 316,949

[22] Filed: Feb. 28, 1989

Related U.S. Application Data

[62] Division of Ser. No. 126,265, Nov. 25, 1987.

[30] Foreign Application Priority Data

Nov. 28, 1986 [FI] Finland ..... 864853

[51] Int. Cl.[5] ..... B65C 3/12; B65C 9/18; B65C 9/22

[52] U.S. Cl. ..... 156/215; 156/257; 156/265; 156/308.8; 156/446; 156/571; 156/DIG. 11; 156/DIG. 33; 156/DIG. 35

[58] Field of Search ..... 156/521, 571, 578, DIG. 31, 156/DIG. 33, DIG. 35, 277, 285, 308.8, 540, 541, 542, 215, 257, 265, DIG. 11, DIG. 13; 264/509

[56] References Cited

U.S. PATENT DOCUMENTS 4,108,706 8/1978 Brands et al. ..... 156/540 X
4,589,949 5/1986 Cavagnino ..... 156/568
4,618,392 10/1986 Uchimura et al. ..... 156/384
4,619,726 10/1986 Cook et al. ..... 156/366

*Primary Examiner*—James Lowe
*Assistant Examiner*—Catherine Timm

[57] ABSTRACT

A method for attaching a label to an outer surface of a package. The label is printed by a printer onto a label web, the label is separated from the web, and tacked to the wrap of the package. The label printed is introduced onto a suction plate, which is arranged on an end of a pivoted swing arm, with a printed side of the label facing the suction plate so that an rim of the label web extends over a pressure roller. Vacuum is applied to the suction plate in order to hold the label, the label is separated from the label web by a shear device and an adhesive precoat is applied on an unprinted side of the label. The package is moved, and the pivoted swing arm is rotated against the package by an actuator (5) so that one edge of the label is brought into an adhering contact with the outer surface of the package by the line pressure exerted by the pressure roller. The label is attached by its tacky surface to the surface of the package in a nip formed between the pressure roller and the package while the movement of the package rotates the pressure roller. The method reduces appreciably the chance of missing the label and provides an easy implementation of automated operation.

4 Claims, 2 Drawing Sheets

1
2
3
4
5
6
7
8
9
10
11
12
13
14
15
16
17
20

METHOD FOR ATTACHING A LABEL TO A SURFACE OF A PACKAGE

This application is a divisional of copending application Ser. No. 07/126,265, filed on Nov. 25, 1987.

BACKGROUND OF THE INVENTION

1. Field of the Invention

The present invention relates to a method for attaching a label to a surface of a package.

2. Description of Background Art

In the inventions of the prior art, the label paper web is trimmed into labels by a separate shear, the labels are transferred by a transfer apparatus from the label printer to a conveyor, and further by a lift apparatus from the conveyor to the surface or wrap of the package.

A disadvantage of the conventional technique is that the equipment becomes complicated making it sensitive to malfunction as well as slow and costly.

SUMMARY AND OBJECTS OF THE INVENTION

The aim of the present invention is to overcome the disadvantages of the prior art technology and to achieve a totally new kind of method for attaching a label to a surface of a package, particularly to a wrap of a roll.

The invention is based on feeding and catching an adhesive-precoated label with the unprinted side downward onto a suction plate mounted at an end of a pivoted swing arm. An edge of the label extends over a pressure roller mounted at an angle joint between the pivoted arm and the suction plate. The upwards facing surface of the adhesive-precoated label is activated and the pivoted swing arm is rotated so that the pressure roller is pressed against the wrap of a moving package, whereby the label tacks to the wrap in a nip formed by the pressure roller and the package.

More specifically, the method in accordance with the invention is characterized by positioning the printed label onto the suction plate wherein a portion of the label is at least partly over a pressure roller positioned adjacent to an angle joint between the swing arm and the suction plate. A separation device is used for separating the label at least partly from the web and a swing arm is utilized to rotate the label adjacent to a package to form a nip between the pressure roller and the package to effect a transfer of the label to the package.

The method in accordance with the invention retains contact with the label on the way from the printer to the package, or wrapped roll, thereby appreciably reducing the possibility of missing a label. Furthermore, the equipment for the implementation of the method is uncomplicated and comprises only a few moving components, which results in a high operational reliability. Thanks to the simplified construction, the manufacturing of the equipment is a low-cost operation and the programming of the automated functions is straightforward.

BRIEF DESCRIPTION OF THE DRAWINGS

The invention is next examined in detail with help of the following exemplifying embodiment according to the attached drawings.

DETAILED DESCRIPTION OF THE INVENTION

Figure 1:
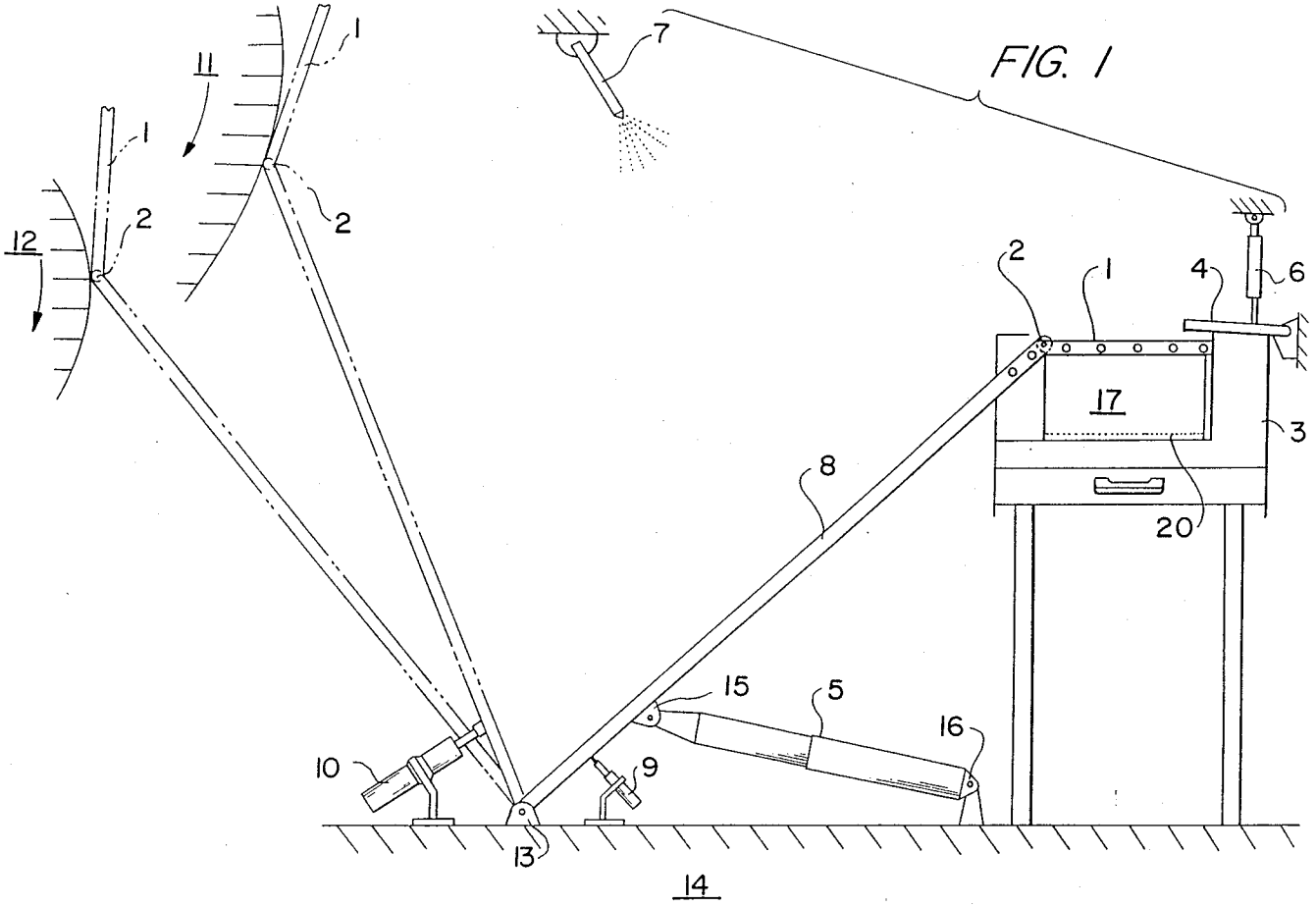
FIG. 1 shows a side view of an apparatus in accordance with the invention.
Figure 2:
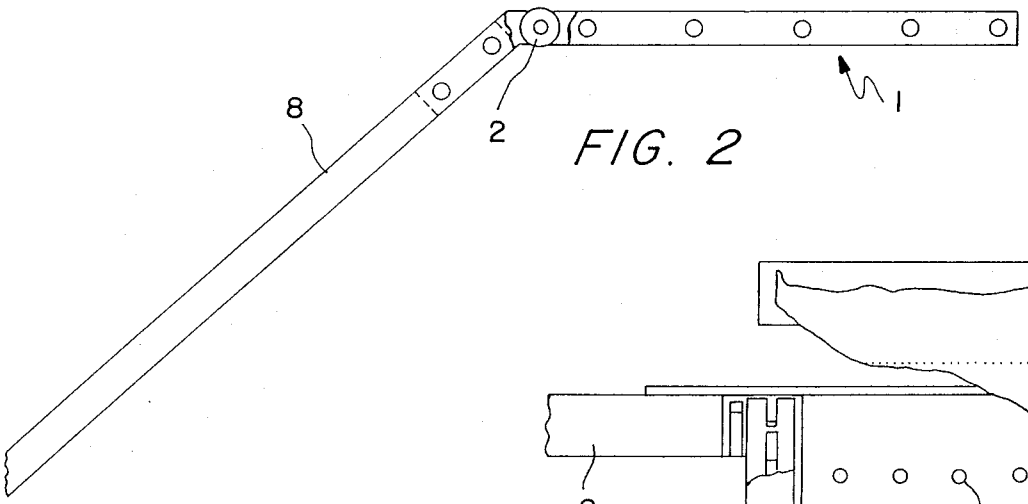
FIG. 2 shows a cross-sectioned side view a detail, namely a suction plate, of the apparatus illustrated in FIG. 1.
Figure 3:
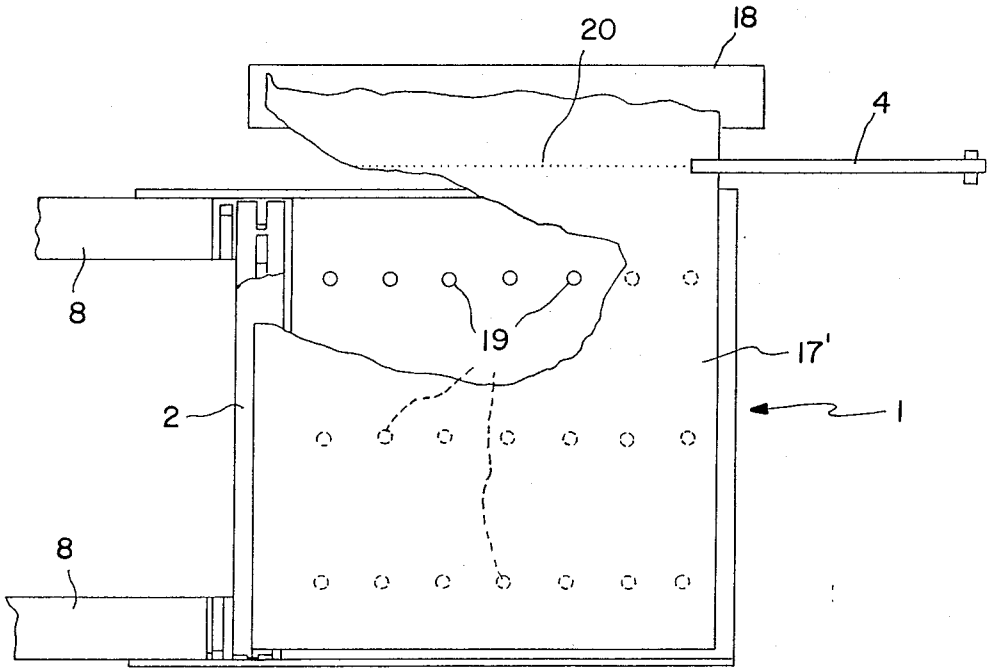
FIG. 3 shows the suction plate illustrated in FIG. 2 in a partly cross-sectioned top view.

In FIGS. 1 to 3 a possible embodiment of an apparatus in accordance with the invention is illustrated. The essential components of the apparatus are a printer 3, a pivoted swing arm 8 consisting of two profiles, a suction plate 1 adapted to the end of the arm, and a freely rotating pressure roller 2 adapted to an angle joint of the suction plate 1 and the swing arm 8. A printer 3 introduces a printed label 17', which is still attached to a label web 17, onto the upper surface of the suction plate 1 with the printed side facing downwards. When the label 17' is advanced sufficiently far over the suction plate 1, the label 17' is latched in place by applying vacuum to the suction plate 1. The correct position of the label 17' is monitored by a photocell adapted to the suction plate 1. The left side of the label 17' extends at least partly over the pressure roller 2 parallel with its axis. A hydraulic cylinder 6 pushes a ripper 4 down, whereby an initial rip is produced at a perforated point 20 of the label web 17. A hydraulic cylinder 5 connected at one end by a pivoted connection 15 to the swing arm 8 and at the other end to a base 14 by a pivoted connection 16, rotates the swing arm 8 about a pivot 13 thereby ripping the label 17' fully off from the label web 17. Above the trajectory of the suction plate 1 from the printer 3 to a wrapped roll 11 is arranged a spray nozzle 7, which is used for wetting the upwardly facing adhesive-precoated reverse side of the label 17'. The swing arm 8 meets a shock absorber 10 mounted close to the pivot 13 that slows down the movement of the swing arm 8 when it meets the wrapped roll 11 and thereby prevents the swing arm 8 from bouncing back. The suction plate 1 is adapted to the upper end of the swing arm 8 pivotally connected to the base 14 so that the angle subtended between the suction plate 1 and the swing arm 8 is obtuse as seen from surface side of the wrapped roll 11. The label 17' meets thereby the outer surface of the wrapped roll 11 in a line contact only backed by the pressure roller 2. The axis of the wrapped roll 11 is aligned essentially parallel with the axis of the pressure roller 2. The wetted label 17' is thus introduced into the nip formed between the wrapped roll 11 and the pressure roller 2 allowing the disconnection of the vacuum applied to the suction plate 1. The position of the label 17' is monitored by the aforementioned photocell throughout all phases of the method. Rotated clockwise by rotating means (not shown), the wrapped roll 11 brings about the attachment of the label 17' to the outer surface of the wrapped roll 11. As soon as the label 17' has passed through the nip, the swing arm 8 is returned to the printer 3 to fetch a new label. Correspondingly, the return movement of the swing arm 8 is retarded by a shock absorber 9 of the return swing mounted close to the pivot 13. An equivalent arrangement is applicable to the attachment of a label to a wrapped roll 12 of smaller diameter.

FIG. 2 illustrates the connection of the suction plate 1 to the swing arm in an enlarged view.

FIG. 3 illustrates in a top view the construction of the suction plate 1 and the ripper 4. The label web 17 is fed from the printer (not shown) in a conventional manner, e.g., by means of feeder rollers, over an anvil plate 18 onto the suction plate 1 so that one rim of the web 17 is aligned at the center line of the pressure roller 2 and the web 17 extends essentially over the entire area of the suction plate 1. When the edge of the web 17 reaches the outer edge of the suction plate 1 and this is detected through monitoring holes by photocells (not shown) mounted under the suction plate, vacuum is applied to the suction plate 1 causing the web 17 to latch against the plate 1 by suction exerted through several suction holes 19. Perforations 20 on the web are at constant spacings making it possible to align the perforation 20 to a desired position, namely centered between the edges of the suction plate 1 and the anvil plate 18. An initial rip is effected to the aligned web 17 at the perforation 20 by a ripper 4. As the swing arm 8 is then raised, a single label 17′ is thereby separated from the label web 17 for wetting and attachment.

Figure 4:
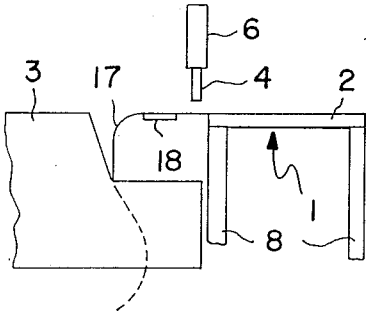
FIG. 4 shows the apparatus illustrated in FIG. 1 and particularly the adaptation of a printer to the suction plate viewed from the direction of a package, or a wrapped roll.

FIG. 4 illustrates the situation as seen from the direction of the wrapped roll 11 when the label web 17 is fed onto the suction plate 1.

The hydraulic cylinders 5 and 6 can be replaced by pneumatic actuators or linear motors. The initial rip of the perforation on the web 17 may alternatively be accomplished by, e.g., an air jet or any conceivable means exerting force on the perforation 20. The role of the shock absorbers 9 and 10 is diminished if the movement of the swing arm 8 is made more defined by, e.g., use of position sensors.

A construction according to the invention may conceivably also be applied to box-shaped packages. The swing arm 8 can then be mounted to a wall so as to align the axis the pressure roller 2 vertical. The label 17′ is then attached to a surface of a package moving on a conveyor in a nip formed between the surface of the package and the pressure roller 2.

In the embodiment illustrated in FIG. 3, the label web may conceivably be fed alternatively from right to left, in which case the ripper 4 and the anvil plate 18 would obviously be adapted in alignment with the axis of the pressure roller 2.

Furthermore, an adaptation to the use of an uncoated and unperforated label web is conceivable, in which case the ripper 4 would be replaced by a shearing means. The adhesion of the label is accomplished by glue which is applied over the upper surface of the label on the suction plate.

What is claimed is:

1. A method for attaching at least one of a plurality of printed labels to a surface of a package comprising the steps of:

(a) introducing at least one of said plurality of printed labels onto an upper surface of a suction plate with a printed side of said at least one label facing the suction plate wherein a portion of said at least one label extends at least partially over a pressure roller located between said suction plate and a swing arm;

(b) applying a vacuum to said suction plate for securing at least one label thereto;

(c) ripping said at least one label from an adjoining one of said plurality of printed labels by a predetermined initial tear amount;

(d) rotating said swing arm toward the surface of said package, thereby completely severing said at least one label from the adjoining one of said plurality of printed labels said swing arm being connected to said suction plate;

(e) wetting an adhesively-precoated reverse side of said at least one printed label positioned on said suction plate as said swing arm is being rotated toward the surface of said package;

(f) slowing movement of said swing arm as the swing arm approaches the surface of said package; and (g) introducing said at least one printed label as said swing arm completes its rotation and said at least one label contacts the surface of said package into a nip formed between said pressure roller and the surface of said package so that said package brings about attachment of said at least one label to the surface of said package as said package rotates and causes said at least one label to pass through the nip.

2. The method according to claim 1 wherein said swing arm is connected to said suction plate with a predetermined obtuse angle therebetween.

3. The method according to claim 1, wherein said step of ripping includes using a shearing means for partially separating said at least one label from a web comprised of said plurality of labels.

4. The method according to claim 1, wherein said step of applying a vacuum to said suction plate is discontinued when said swing arm contacts the surface of said package.

* * * * *